United States Patent [19]

Manaka et al.

[11] Patent Number: 4,953,530

[45] Date of Patent: Sep. 4, 1990

[54] THROTTLE VALVE OPENING DEGREE CONTROLLING APPARATUS FOR INTERNAL COMBUSTION ENGINE

[75] Inventors: Toshio Manaka, Katsuta; Masami Shida, Mito, both of Japan

[73] Assignee: Hitachi, Ltd., Tokyo, Japan

[21] Appl. No.: 375,901

[22] Filed: Jul. 6, 1989

[30] Foreign Application Priority Data

Jul. 29, 1988 [JP] Japan ..... 63-188164

[51] Int. Cl.[5] ..... F02D 11/10

[52] U.S. Cl. ..... 123/399; 123/492

[58] Field of Search ..... 123/399, 492, 340

[56] References Cited

U.S. PATENT DOCUMENTS

| | | | |
|---|---|---|---|
| 2,859,738 | 11/1958 | Campbell | 123/492 |
| 3,964,443 | 1/1976 | Hartford | 123/492 |
| 3,969,614 | 8/1976 | Moyer | 123/492 |
| 4,357,923 | 11/1982 | Hidag | 123/492 |
| 4,765,295 | 8/1988 | Ishikawa et al. | 123/399 |
| 4,765,296 | 8/1988 | Ishikawa et al. | 123/399 |
| 4,809,659 | 3/1989 | Tamaki et al. | 123/399 |
| 4,811,712 | 3/1989 | Itow | 123/399 |
| 4,819,598 | 4/1989 | Mueller | 123/399 |

*Primary Examiner*—Raymond A. Nelli

*Attorney, Agent, or Firm*—Antonelli, Terry, Stout & Kraus

[57] ABSTRACT

A control unit has a fuel supply controller and a throttle valve opening degree controller. The fuel supply amount controller estimates and calculates the amount of fuel being supplied in cylinders with a real time. The throttle valve opening degree controller calculates a necessary opening degree so as to give a predetermined air-fuel ratio in accordance with a result value by the fuel supply amount controller. The fuel supply amount controller has a processing in which a fuel supply amount is corrected in accordance with an increase or decrease rate of an amount of fuel being adhered to an inner wall surface of an intake pipe. The throttle valve opening degree is controlled in accordance with a value obtained from the throttle valve opening degree controller as a control target value. A time lag in a follow-up for fuel is anticipated in advance, a desirable target air-fuel ratio is maintained correctly and easily.

16 Claims, 9 Drawing Sheets

THROTTLE VALVE OPENING DEGREE CONTROLLING APPARATUS FOR INTERNAL COMBUSTION ENGINE

BACKGROUND OF THE INVENTION

The present invention relates to a throttle valve opening degree controlling apparatus for an internal combustion engine and, more particularly to a throttle valve opening degree controlling apparatus for an internal combustion engine in which for an internal combustion engine suitable for a gasoline engine of an automobile etc. the fuel supply amount into the internal combustion engine is controlled electronically via an actuator for controlling an opening degree of a throttle valve.

In a conventional internal combustion engine such as a gasoline engine, a fuel is adhered to an inner wall surface portion of an intake passage such as an intake pipe of the internal combustion engine. As a result, it has been known that it is necessary to carry out a correction or an amendment processing for an air-fuel ratio (A/F) control.

In the conventional internal combustion engine apparatus, for example in U.S. Pat. No. 4,357,923, the difference of the air-fuel ratio (A/F) due to the above stated fuel being adhered to the inner wall surface portion of the intake passage (herein-after called as an intake surface adhesion fuel) has been compensated in accordance with an adjustment of a correction fuel injection amount against a predetermined supply fuel amount.

In the above stated conventional adjustment technique for the correction fuel injection amount, when the intake air amount changes suddenly such as the quick accelerating operation or the quick decelerating operation on the engine, it impossible completely to carry out a follow-up characteristic for the fuel injection amount control.

So as to compensate such an insufficiency in the follow-up characteristic for the fuel injection amount control, the time lag in the follow-up for the fuel injection amount control is estimated at the sudden change state in the intake air amount, and the above stated correction fuel injection amount is calculated according to a result of the estimation for the follow-up characteristic for the fuel injection amount.

SUMMARY OF THE INVENTION

An object of the present invention is to provide an throttle valve opening degree controlling apparatus for an internal combustion engine wherein a difference in an air-fuel ratio (A/F) caused by an intake surface adhesion fuel amount can be corrected at all times and fully whenever including a transitional period.

Another object of the present invention is to provide a throttle valve opening degree controlling apparatus for an internal combustion engine wherein a quantitative time lag in a follow-up for fuel can be anticipated in advance.

A further object of the present invention is to provide a throttle valve opening degree controlling apparatus for an internal combustion engine wherein a control for a change condition of an intake air flow amount corresponding to an anticipated time lag in a follow-up for fuel can be attained.

In accordance with the present invention, a throttle valve opening degree controlling apparatus for an internal combustion engine comprises a throttle valve being arranged to the internal combustion engine, an accelerator pedal being arranged to the internal combustion engine, a first actuator for controlling an opening degree of the throttle valve, and a second actuator for controlling an amount of fuel being supplied into cylinders of the internal combustion engine, in which an amount of fuel being injected is controlled electronically by an amount of an intake air for flowing into the internal combustion engine and the amount of the fuel being supplied into the internal combustion engine in accordance with a data stored in a control unit and for controlling the internal combustion engine.

The throttle valve opening degree controlling apparatus comprises further a fuel supply amount executing means for estimating and calculating the amount being supplied in the cylinders of the internal combustion engine with a real time, and a throttle valve opening degree executing means for calculating a necessary throttle valve opening degree so as to give a predetermined air-fuel ratio (A/F) in accordance with an estimating and calculating value by the fuel supply amount executing means, thereby the first actuator for controlling the throttle valve opening degree is controlled in accordance with a calculation value of the throttle valve opening degree executing means as a control target value.

An estimating and calculating processing in the fuel supply amount executing means is constituted to have a processing in which an amount of fuel being supplied from the second actuator for controlling the amount of fuel being supplied is corrected in accordance with an increase rate or a decrease rate of an amount of fuel being adhered to an inner wall surface portion of an intake air flow passage of the engine.

The increase rate or decrease rate of the intake surface adhesion fuel amount is requested from a first value multiplying a difference between an equivalence intake surface adhesion fuel amount being given as a function of a parameter for operating the engine and a predetermined period previous intake surface adhesion fuel amount of being given as a function of a parameter for operating the engine by a constant of a parameter for operating the engine, a present intake surface adhesion fuel amount is given as a second value adding the first value to the predetermined period previous intake surface adhesion fuel amount, and an executed result is given as a third value obtained dividing a difference between the present intake surface adhesion fuel amount and the predetermined period previous intake surface adhesion fuel amount by the predetermined period.

A control of the first actuator for controlling the opening degree of the throttle valve is constituted to have a feed-back control so as to work for converging at the control target value in accordance with a detected value of an actual amount of the intake air flow, a detected value of an actual air-fuel ratio, or a detected value of an actual intake pipe pressure.

Each difference between an amount of fuel being supplied from the second actuator for controlling the amount of fuel being supplied and an amount of fuel being taken into the cylinders is integrated, and an obtained integrated value is stored successively in a memory member being dividing according to a parameter for operating the engine as a learning value for the equivalence intake surface adhesion fuel amount.

The amount of fuel being taken into the cylinders is executed at least one of a detected value of an actual air-fuel ratio, an amount of the intake air flow being calculated in accordance with the intake pipe pressure and an engine speed, an amount of the intake air flow being calculated in accordance with an opening degree of the throttle valve and the engine speed, and a detected value of an actual amount of the intake air flow.

The above-stated objects of the present invention are attained according to facts in which a time lag in a follow-up for an amount of fuel being supplied is estimated from a change rate of the intake surface adhesion fuel amount, and from this obtained result a control for an intake air amount is carried out in accordance with the time lag in a follow-up for the amount of fuel being supplied.

Since an actuator for controlling the intake air amount can be corresponded to the time lag in the supply for fuel, accordingly it is possible to carry out a delay control in anticipation of the supply delay of fuel, and further there is no occasion that only a change of the intake air goes ahead of. Therefore the air-fuel ratio (A/F) in the present invention can be controlled accurately at all times including the transitional period.

According to the present invention, since a quantitative time lag in a follow-up for fuel is anticipated in advance, a control for a change condition of an intake air flow amount corresponding to an anticipated time lag in a follow-up for fuel is attained, therefore a desirable target air-fuel ratio $(A/F)_o$ can be maintained correctly and easily at all times.

DESCRIPTION OF THE INVENTION

One embodiment of a throttle valve opening degree controlling apparatus for an internal combustion engine according to the present invention will be explained in detail referring to the illustrated embodiments.

Figure 2:
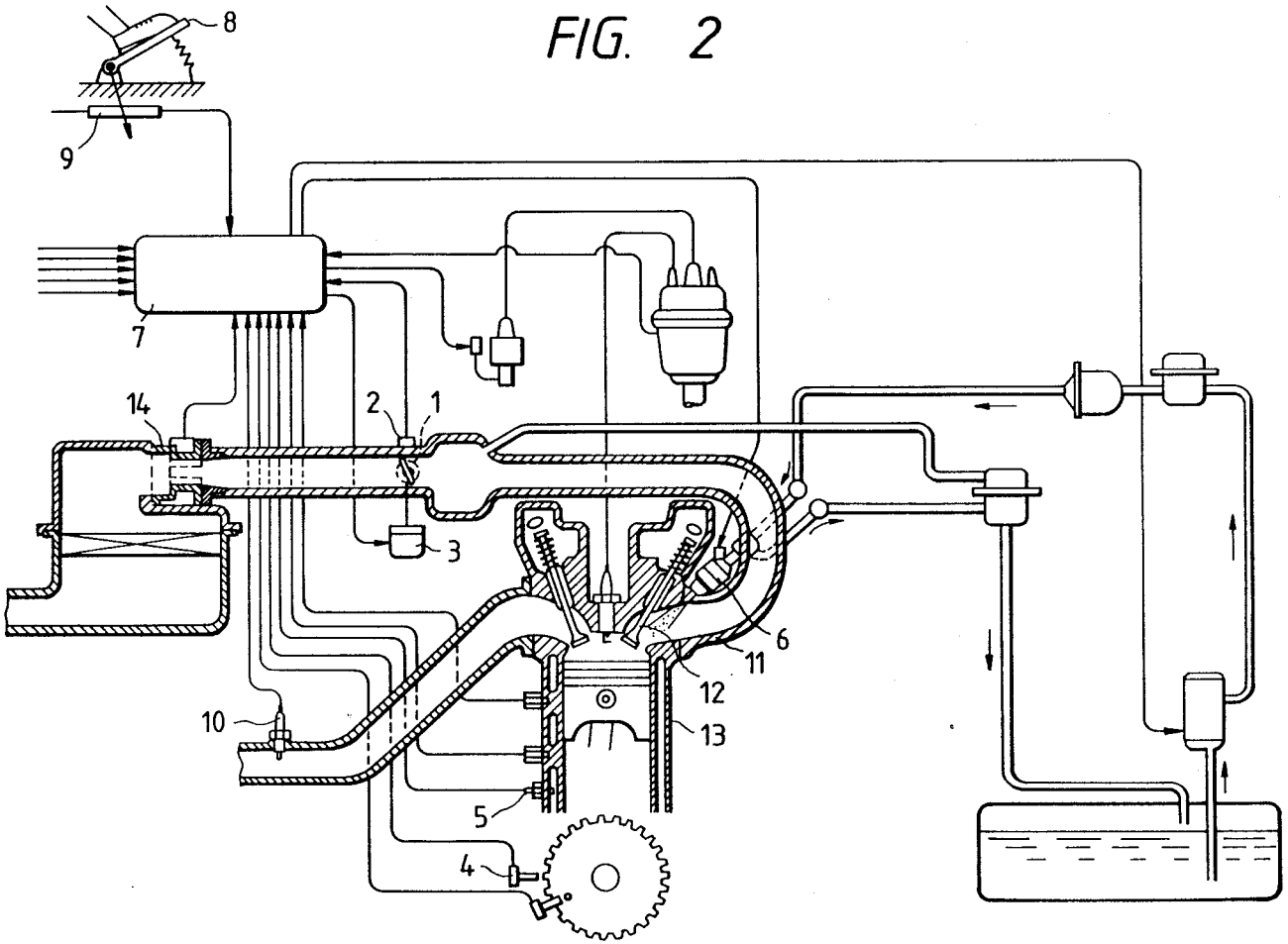
FIG. 2 is an engine control system block diagram adopting one embodiment of a throttle valve opening degree controlling apparatus for an internal combustion engine according to the present invention.

First all, FIG. 2 shows one example of an internal combustion engine control apparatus in which one embodiment of a throttle valve opening degree controlling apparatus for an internal combustion engine suitable for a gasoline engine in an automobile according to the present invention is adopted.

An engine control apparatus for a gasoline engine 31 of an automobile includes a throttle valve 1, a throttle valve opening degree detecting sensor 2 mounted on the throttle valve 1, a throttle valve actuator 3 for actuating the throttle valve 1 and for controlling an opening degree of the throttle valve 1, an engine speed detecting sensor 4 mounted on an internal combustion engine main body.

The engine control apparatus includes further a water temperature detecting sensor 5 mounted on the internal combustion engine main body, an injector 6 being as an actuator for controlling a fuel supply amount, a control unit 7, an acceleration pedal operating amount detecting sensor 9 disposed on an acceleration pedal 8, an oxygen concentration detecting sensor ($O_2$ sensor) 10 mounted on an exhaust pipe of the engine 31, and an air flow sensor 14 mounted at an entrance of an intake pipe 11 of the engine 31. The internal combustion engine 31 includes respectively an intake valve 12 and cylinders 13 in an intake passage.

Through the detections by utilizing the above stated various kinds of the detecting sensors, respective control signals which are a throttle valve opening degree $\theta_{th}$, an engine speed N, an engine temperature $T_w$, an acceleration pedal operating amount $\theta_{ac}$, an air-fuel ratio (A/F), and an intake air flow amount $Q_a$ etc., are inputted respectively into the control unit 7.

A fuel injection pulse width $T_i$, which is given by the result of execution processings of these control signals, is outputted to the injector 6 being as an actuator for controlling the fuel supply amount, thus the fuel supply amount control is carried out in the engine control apparatus.

Besides, the throttle valve actuator 3 is mounted on the throttle valve 1 and, by the operation of this throttle valve actuator 3, the opening degree $\theta_{th}$ of the throttle valve 1 or the throttle valve opening degree $\theta_{th}$ is given. A control signal for controlling this throttle valve actuator 3 is given through the control unit 7 in accordance with the result of execution processings for the above stated various kinds of the control signals.

Figure 3:
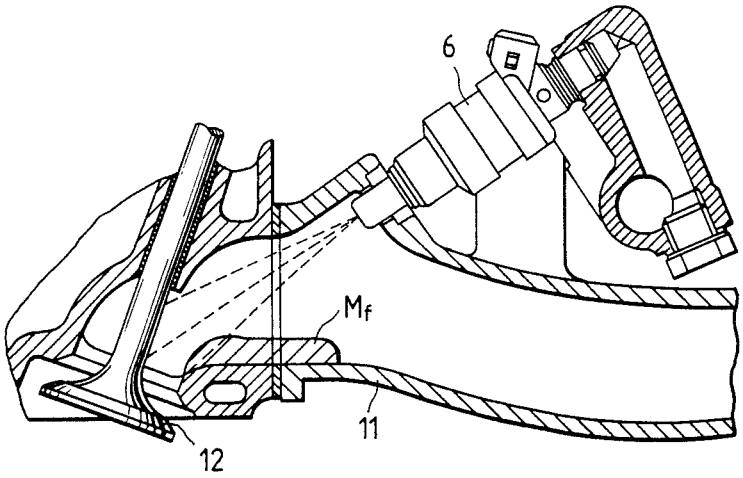
FIG. 3 is an explanatory view for showing an intake surface adhesion fuel amount in an inner wall surface portion of an intake pipe.

FIG. 3 shows a situation with a cross-sectional structure in which a part of the fuel being injected from the injector 6 adheres with an inner wall surface portion of the intake pipe 11 as an intake passage and stays at the inner wall surface portion thereof.

When an amount of this adhered fuel adhered to the inner surface portion of the intake pipe 11 is defined as an intake surface adhesion fuel amount $M_f$, this intake surface adhesion fuel amount $M_f$ is varied in various ways in accordance with the temperature at the surface portion of the intake pipe 11, the pressure in the intake pipe 11, and the intake air velocity for flowing in the intake pipe 11 etc.

In general, when the more the temperature at the surface portion of the intake pipe 11 is low, the more the intake pipe pressure (an absolute pressure) in the intake pipe 11 is high, or the more the intake air velocity for flowing in the intake pipe 11 is slow, in such a case the more the intake surface adhesion fuel amount $M_f$ increases.

The more the rate in increase of this intake surface adhesion fuel amount $M_f$ is large, the more the fuel amount for sending out into the cylinders 13 per unit a time or per one stroke reduces. Therefore it means that the intake surface adhesion fuel amount $M_f$ corresponding to the reduced part or the reduced amount of the fuel amount to be supplied increases.

Figure 1:
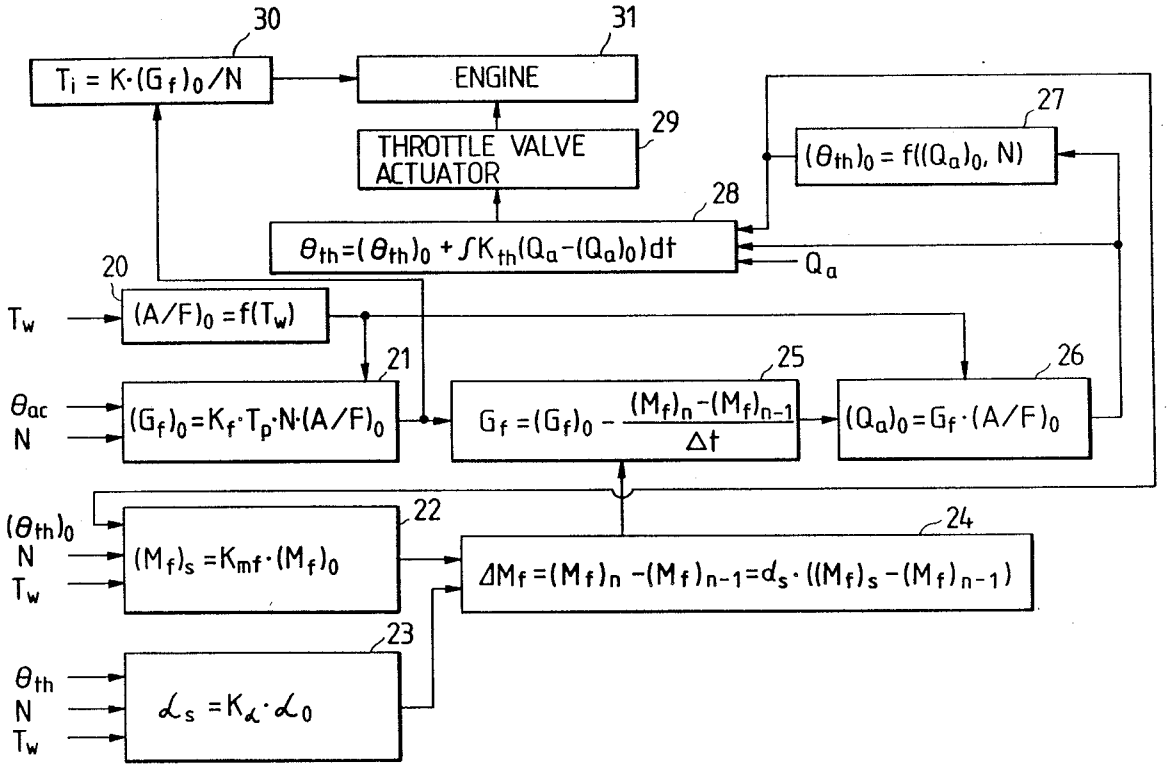
FIG. 1 is a control block diagram showing one embodiment of a throttle valve opening degree controlling apparatus for an internal combustion engine according to the present invention.

In this embodiment of the present invention, taking into consideration the above stated situations for the fuel injection amount, the various control processings for the fuel injection amount are executed in accordance with the control unit 7 as shown in FIG. 1.

FIG. 1 is a control block diagram showing the contents of the control processings for the fuel injection amount in accordance with the control unit 7. In each block of control blocks 20, 21, 22, and 23 in the control unit 7, a desirable target air-fuel ratio $(A/F)_o$, a desirable target supply fuel amount $(G_f)_o$, an equivalence intake surface adhesion fuel amount $(M_f)_o$, and a corrected filter gain $\alpha_s$ is calculated respectively.

In the next control block 24 in the control unit 7, a difference adhesion fuel amount $\Delta M_f$ of the present intake surface adhesion fuel amount $(M_f)_n$ is calculated at every predetermined time $\Delta t$ in accordance with the following formula.

$$\Delta M_f=(M_f)_n-(M_f)_{n-1} \quad (1)$$

wherein $(M_f)_n$ is a present intake surface adhesion fuel amount, and $(M_f)_{n-1}$ is a previous intake surface adhesion fuel amount.

In a control block 25 in the control unit 7, the desirable target supply fuel amount $(G_f)_o$, the difference adhesion fuel amount $\Delta M_f$ of the present intake surface adhesion fuel amount $(M_f)_n$, and an actual supply fuel amount $G_f$ for flowing into the cylinders 13 of the engine 31 per a predetermined time $\Delta t$ are calculated.

In a control block 26 in the control unit 7, a desirable target intake air flow amount $(Q_a)_o$ is executed in accordance with this actual intake surface adhesion fuel amount $G_f$ and the desirable target air-fuel ratio $(A/F)_o$. With thus obtained desirable target intake air flow amount $(Q_a)_o$, the throttle valve actuator 3 is controlled so as to give a desirable target throttle valve opening degree $(\theta_{th})_o$ in accordance with a control block 27 in the control unit 7.

Further at this time, in a control block 28 and a control block 29 in the control unit 7, a correction processing for the fuel injection amount due to a feedback control is carried out, in which a difference between the desirable target intake air flow amount $(Q_a)_o$ and an actual intake air flow amount $Q_a$ which is detected actually by the air flow sensor 14 is made to converge at zero in addition to this desirable target throttle valve opening degree $(\theta_{th})_o$.

However, this correction processing for the throttle valve opening degree $\theta_{th}$ may carry out in accordance with the following formula.

$$\theta_{th}=(\theta_{th})_o+\int K_{th}\cdot((A/F)-(A/F)_o)dt$$

or $$\theta_{th}=(\theta_{th})_o+\int K_{th}\cdot(P_b-(P_b)_o)dt$$

wherein $(P_b)_o$(ata) is a desirable target intake pipe pressure, $P_b$ (ata) is an actual intake pipe pressure, and $K_{th}$ is a correction coefficient.

These facts mean that the correction for the throttle valve opening degree $\theta_{th}$ is carried out so as to give the desirable target air-fuel ratio $(A/F)_o$ or the desirable target intake pipe pressure $(P_b)_o$.

Besides, in accordance with the desirable target supply fuel amount $(G_f)_o$ which is given by the control block 21 in the control unit 7, in a control block 30 in the control unit 7, the fuel injection pulse width $T_i$ (ms) is executed by the following formula.

$$T_i=K\cdot(G_f)_o/N$$

wherein N is the engine speed, and K is a correction coefficient.

By this fuel injection pulse width $T_i$ (ms) is outputted to the injector 6 of the engine control apparatus, thereby the engine 31 is controlled so as to present the desirable target air-fuel ratio $(A/F)_o$.

Next, the characteristic of each data shown in FIG. 1 will be explained.

Figure 4:
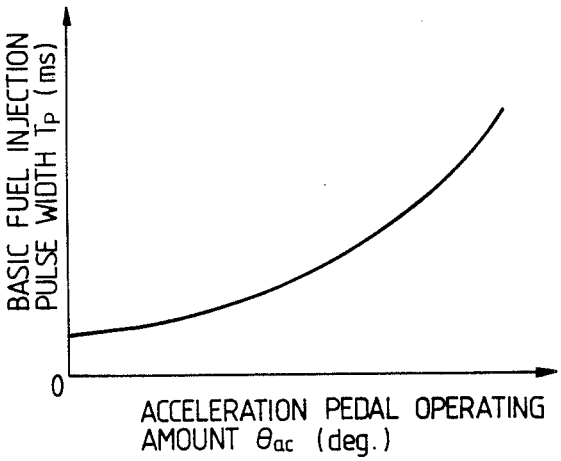
FIG. 4 is a characteristic view showing a basic injection pulse width for an engine control apparatus.

First of all, FIG. 4 is a characteristic view showing a basic fuel injection pulse width $T_p$ (ms) in regard to the acceleration pedal operating amount $\theta_{ac}$. This characteristic is one that when the more the acceleration pedal 8 is stepped-in largely, the more the basic fuel injection pulse width $T_p$ (ms) is made to lengthen, thereby a lot of fuel is made to supply into the cylinders 13 of the engine 31.

Figure 5:
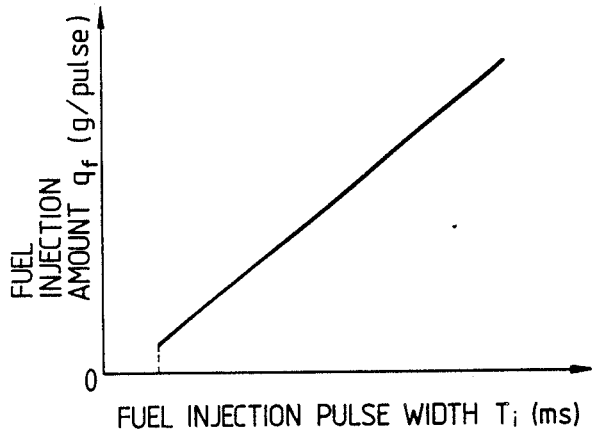
FIG. 5 is a characteristic view showing a fuel injection amount for an engine control apparatus.

Next, FIG. 5 is a characteristic view showing the relationship between the fuel injection pulse width $T_i$ (ms) and the fuel injection amount $g_f$(g/pulse) from the injector 6. The fuel injection pulse width $T_i$ (ms) and the fuel injection amount $g_f$ (g/pulse) show a practically proportional relationship therebetween.

Figure 6:
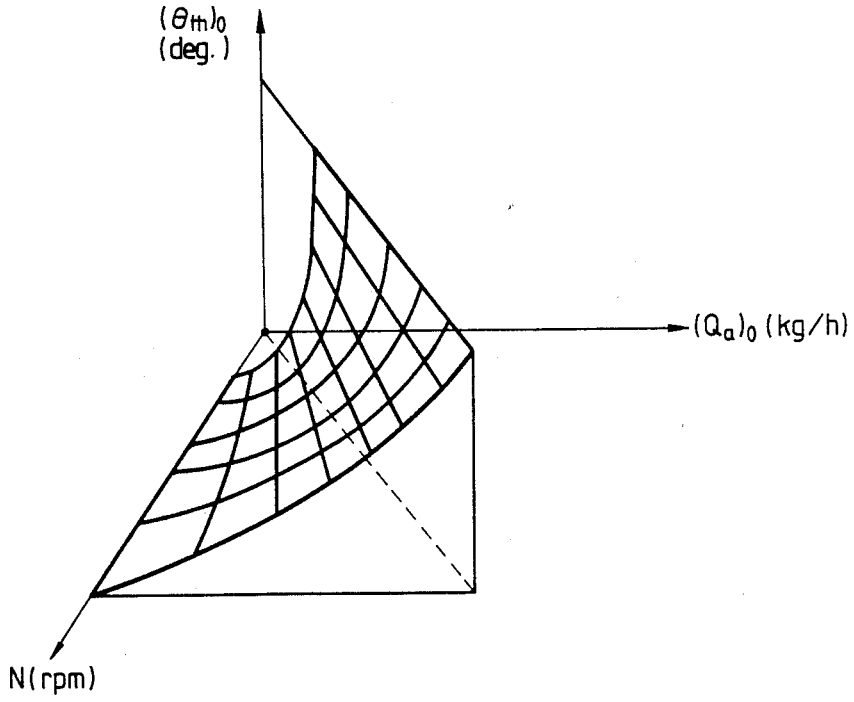
FIG. 6 is a characteristic view showing a desirable target throttle valve opening degree necessary for obtaining a desirable target intake air flow amount.

FIG. 6 is a characteristic view showing the desirable target throttle valve opening degree $(\theta_{th})_o$(degree) necessary for obtaining the desirable target intake air flow amount $(Q_a)_o$(kg/h). The desirable target throttle valve opening degree $(\theta_{th})_o$(degree) is a variable of the engine speed N (rpm).

Accordingly, FIG. 6 is constituted as a map in which the desirable target throttle valve opening degree $(\theta_{th})_o$ is searched in accordance with these datum comprising the desirable target intake air flow amount $(Q_a)_o$ and the engine speed N.

Figure 7:
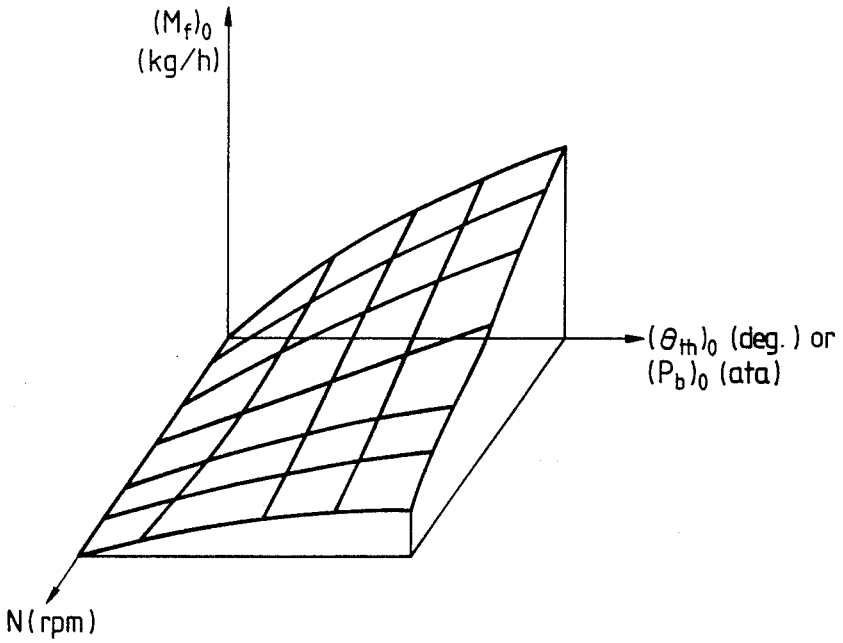
FIG. 7 is a characteristic view showing an equivalence intake surface adhesion fuel amount obtained from each function.

FIG. 7 is a characteristic showing the equivalence intake surface adhesion fuel amount $(M_f)_o$. This equivalence intake surface adhesion fuel amount $(M_f)_o$ is given similarly in accordance with the search by the map. The equivalence intake surface adhesion fuel amount $(M_f)_o$ is given from the functions of the engine speed N, the desirable target throttle valve opening degree $(\theta_{th})_o$ being given corresponding to the desirable target intake air flow amount $(Q_a)_o$, or the desirable target intake pipe pressure $(P_b)_o$.

However, in this case, in place of the desirable target throttle valve opening degree $(\theta_{th})_o$ or the desirable target intake pipe pressure $(P_b)_o$, for example, the data such as an index indicating the engine load, which are the engine torque, the intake air amount per one rotation of the engine 31, the pressure in the cylinders 13 etc., may use therefor.

Figure 8:
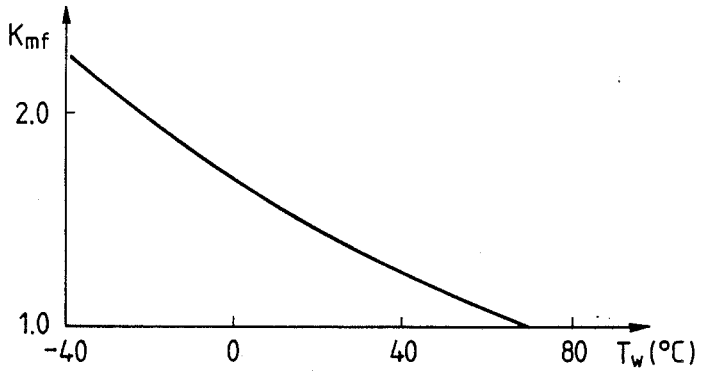
FIG. 8 is a characteristic view showing a correction coefficient depending on an engine temperature for an intake surface adhesion fuel amount.

The equivalence intake surface adhesion fuel amount $(M_f)_o$ depends also on the engine temperature $T_w$. The engine temperature $T_w$ is used for the control by utilizing a correction coefficient $K_{mf}$ according to the engine temperature $T_w$ as shown in FIG. 8. Accordingly, when a corrected equivalence intake surface adhesion fuel amount is expressed as $(M_f)_s$, the following formula holds.

$$(M_f)_s=(M_f)_o \cdot K_{mf}$$

Figure 9:
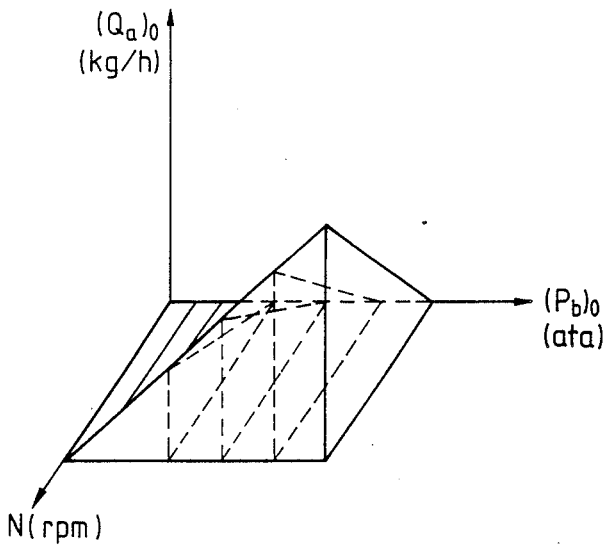
FIG. 9 is a characteristic view showing a desirable target intake air flow amount calculated from a desirable target intake pipe pressure and an engine speed.

Herein, FIG. 9 is a characteristic view showing in which the desirable target intake air flow amount $(Q_a)_o$ can be calculated from the desirable target intake pipe pressure $(P_b)_o$ and the engine speed N.

From the characteristic view shown in FIG. 9 and the characteristic view shown in FIG. 6, the desirable target throttle valve opening degree $(\theta_{th})_o$ corresponding to the desirable target intake pipe pressure $(P_b)_o$ can be calculated. As a result, it is possible to control so as to become at the desirable target throttle valve opening degree $(\theta_{th})_o$ by utilizing this the desirable target intake pipe pressure $(P_b)_o$.

Figure 10:
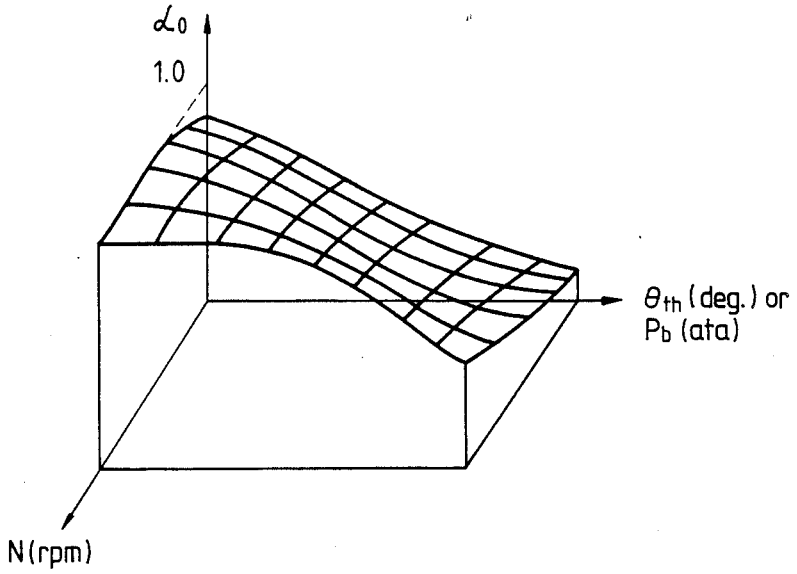
FIG. 10 is a characteristic view showing a filter gain which is defined as a change rate of an intake surface adhesion fuel amount.

Next, FIG. 10 is a characteristic view showing a constant $\alpha_o$ which is defined as a change speed of the intake surface adhesion fuel amount $M_f$. This constant $\alpha_o$ is a function of the engine speed N, the actual throttle valve opening degree $\theta_{th}$, or the actual intake pipe pressure $P_b$. Herein-after this constant $\alpha_o$ is called as a filter gain.

Figure 11:
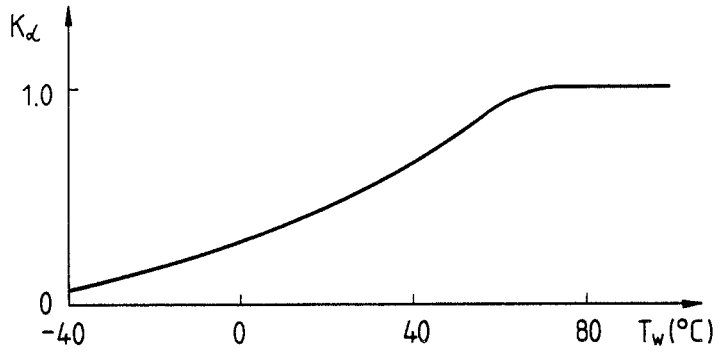
FIG. 11 is a characteristic view showing a corrected filter gain required as a function from an engine temperature.

The filter gain $\alpha_o$ depends on the engine temperature $T_w$ and is the function thereof as comprehended from FIG. 7 and FIG. 8. As a result, a corrected filter gain $\alpha_s$ is calculated in accordance with the following formula by utilizing a correction coefficient $K_\alpha$ required as the function of the engine temperature $T_w$ shown in FIG. 11.

$$\alpha_s=\alpha_o \cdot K_\alpha$$

Accordingly, when the present intake surface adhesion amount is defined as $(M_f)_n$, this present intake surface adhesion amount $(M_f)_n$ is executed at every predetermined period in accordance with the following formula.

$$(M_f)_n=(M_f)_{n-1}+\alpha_s((M_f)_s-(M_f)_{n-1})$$

wherein $(M_f)_{n-1}$ in the above stated formula is an intake surface adhesion fuel amount at the time before the predetermined period from the present time.

The meaning of the above stated corrected filter gain $\alpha_s$ will be explained as follows. This corrected filter gain $\alpha_s$ corresponds to an inverse number of a time constant in regard to the change of the intake surface adhesion fuel amount $M_f$. Accordingly, the less the corrected filter gain $\alpha_s$ is low than 1.0, the more the time constant lengthens.

When the corrected filter gain $\alpha_s$ equals to just 1.0, the present intake surface adhesion fuel amount $(M_f)_n$ comes immediately to equal the corrected equivalence intake surface adhesion fuel amount $(M_f)_s$ and this fact means that the engine operating condition is at the follow-up condition without time lag.

Figure 12:
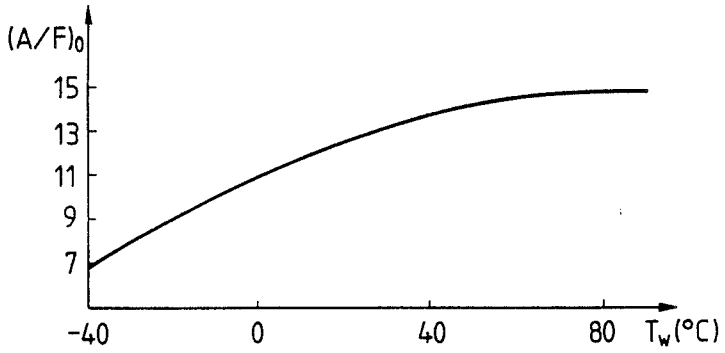
FIG. 12 is a characteristic view showing a desirable target air-fuel ratio in regard to an engine temperature.

Besides, FIG. 12 is a characteristic view showing the desirable target air-fuel ratio $(A/F)_o$ in regard to the engine temperature $T_w$. In proportion to the engine temperature $T_w$ lowers, it is necessary to make rich the air-fuel ratio (A/F). Therefore, there is necessary to take this fact into consideration for the engine control apparatus.

An injection control operation in which the engine control processings shown in FIG. 1 are executed under the above stated various characteristics will be explained as follows.

Figure 13:
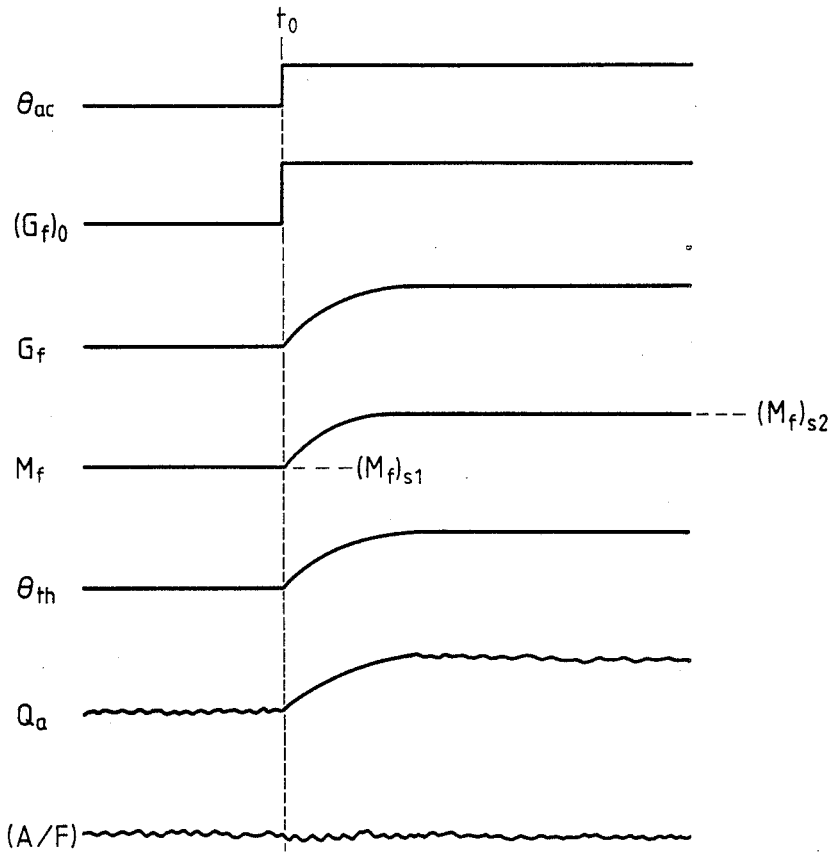
FIG. 13 is a timing flow-chart for explaining an operation for various control signals in a control unit.

First of all, FIG. 13 shows an operation in which at the time $t_o$ the acceleration pedal 8 is stepped into, then the acceleration pedal operating amount $\theta_{ac}$ increases with a step-wise state. As a result, at the time $t_o$ the desirable target supply fuel amount $(G_f)_o$ increases also with a step-wise state.

However, a part of the desirable target supply fuel amount $(G_f)_o$ is spent so as to increase the intake surface adhesion fuel amount $M_f$ from one side equivalence intake surface adhesion fuel amount $(M_f)_{s1}$ to the other side equivalence intake surface adhesion fuel amount $(M_f)_{s2}$.

Therefore, the change at the increase direction of the actual supply fuel amount $G_f$ flowing into the cylinders 13 is not made with a step-wise state, and as a result the actual supply fuel amount $G_f$ increases comparatively loosely from the time $t_o$.

Besides, in this embodiment of the present invention, the throttle valve 1 is not operated directly via the acceleration pedal 8 but the opening degree $\theta_{th}$ of the throttle valve 1 is operated via the throttle valve actuator 3. The throttle valve opening degree $\theta_{th}$ at this time is determined with the following executing processing in the control block 26 in the control unit 7 shown in FIG. 1.

$$(Q_a)_o=G_f(A/F)_o$$

In accordance with the above stated executing processing, the throttle valve opening degree $\theta_{th}$ is made to increase so as to correspond to the desirable target intake air flow amount $(Q_a)_o$. As a result, the air-fuel ratio (A/F) can be maintained at the desirable state having no difference thereof as shown in FIG. 13.

Figure 14:
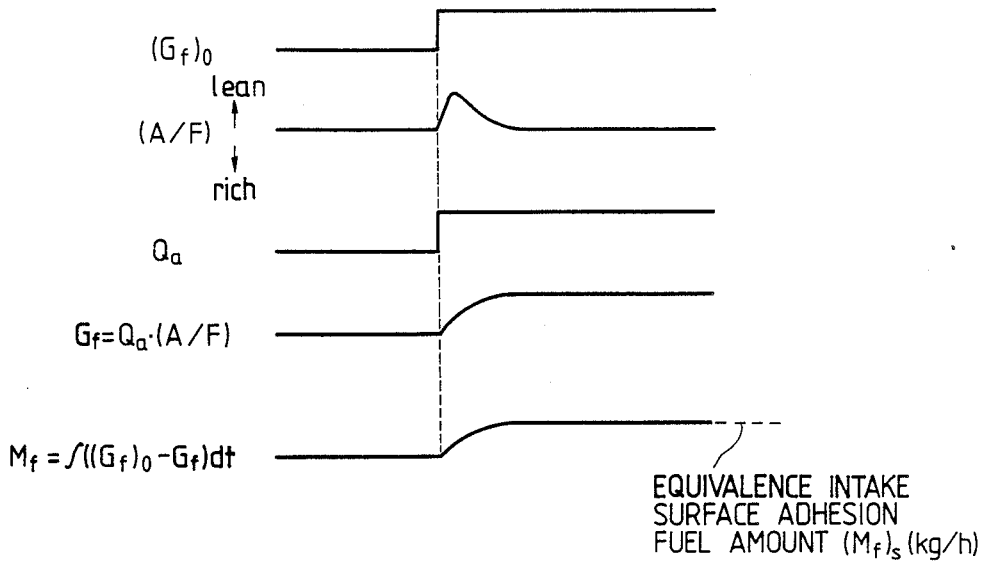
FIG. 14 is an explanatory view showing an operation for calculating an intake surface adhesion fuel amount with various control signals in a control unit.
Figure 15:
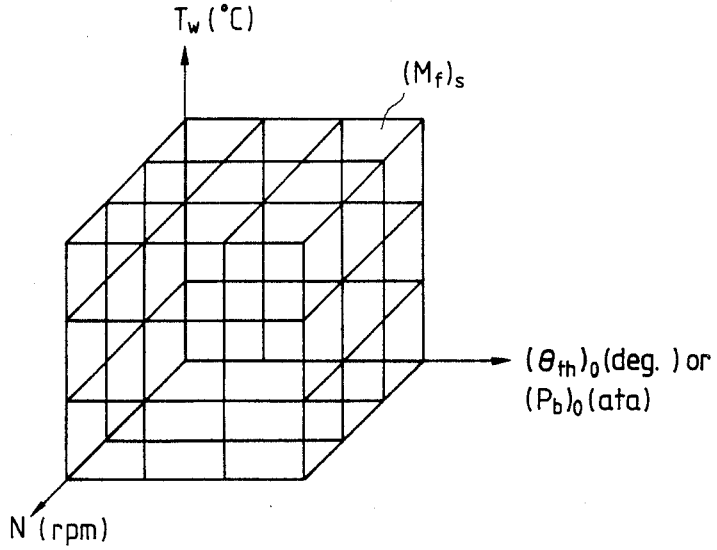
FIG. 15 is an explanatory view showing a control map divided to each control signal.

Next, FIG. 14 and FIG. 15 are explanatory views showing the control processing for calculating the intake surface adhesion fuel amount $M_f$ in accordance with the actual air-fuel ratio (A/F) detected by $O_2$ sensor 10, the desirable target fuel supply amount $(G_f)_o$, and the actual intake air flow amount $Q_a$.

When the fuel amount flowing actually into the cylinders 13 is defined as $G_f$, the intake surface adhesion fuel amount $M_f$ is calculated in accordance with the product of the difference between the desirable target supply fuel amount $(G_f)_o$ and the actual supply fuel amount $G_f$ into the cylinders 13.

As shown in FIG. 14, the desirable target supply fuel amount $(G_f)_o$ is requested by the actual intake air flow amount $Q_a$ and the actual air-fuel ratio (A/F), and as a result the intake surface adhesion fuel amount $M_f$ is executed by the obtained desirable target supply fuel amount $(G_f)_o$. In this case, the actual intake air flow amount $Q_a$ may be requested in accordance with the data value calculated according to the actual intake pipe pressure $P_b$, or the actual throttle valve opening degree $\theta_{th}$ etc.

Thus obtained equivalence intake surface adhesion fuel amount $(M_f)_s$ is stored successively in the control memory area or memory map being provided on the control unit 7 which is divided to the engine speed N, the desirable target throttle valve opening degree $(\theta_{th})_o$ or the desirable target intake pipe pressure $(P_b)_o$, and the engine temperature $T_w$ as shown in FIG. 15.

The stored equivalence intake surface adhesion fuel amount $(M_f)_s$ can in use for the control processings in replace of the control processings according to the characteristics shown in FIG. 7 and FIG. 8, or can in use for the amendment of these characteristics, namely it can adopt for the learning control.

According to the above stated embodiment of the present invention, since the quantitative time lag in the follow-up for fuel, which actually flows into the cylinders of the engine corresponding to the operation by the acceleration pedal, is anticipated in advance, it is possible to control the change conditions of the intake air flow amount corresponding to the anticipated time lag in the follow-up for fuel, accordingly a desirable target air-fuel ratio $(A/F)_o$ can be maintained correctly and easily at all times.

I claim:

1. A throttle valve opening degree controlling apparatus for an internal combustion engine comprising a throttle valve being arranged to the internal combustion engine, an acceleration pedal being arranged to the internal combustion engine, a first actuator for controlling an opening degree of said throttle valve, and a second actuator for controlling an amount of fuel being supplied into cylinders of the internal combustion engine, in which an amount of fuel being injected is controlled electronically by an amount of an intake air for flowing into the internal combustion engine and the amount of the fuel being supplied into the internal combustion engine in accordance with a data stored in a control unit and for controlling the internal combustion engine wherein said throttle valve opening degree controlling apparatus comprises further a fuel supply amount executing means for estimating and calculating the amount being supplied in said cylinders of the internal combustion engine with a real time, and a throttle valve opening degree executing means for calculating a necessary throttle valve opening degree so as to give a predetermined air-fuel ratio in accordance with an estimating and calculating value by said fuel supply amount executing means, thereby said first actuator for controlling the throttle valve opening degree is controlled in accordance with a calculation value of said throttle valve opening degree executing means as a control target value.

2. A throttle valve opening degree controlling apparatus for an internal combustion engine according to claim 1, wherein an estimating and calculating processing in said fuel supply amount executing means is constituted to have a processing in which an amount of fuel being supplied from said second actuator for controlling the amount of fuel to be supplied is corrected in accordance with an increase rate or a decrease rate of an amount of fuel being adhered to an inner wall surface portion of an intake air flow passage of the internal combustion engine.

3. A throttle valve opening degree controlling apparatus for an internal combustion engine according to claim 2, wherein said increase rate or said decrease rate of said intake surface adhesion fuel amount is requested from a first value multiplying a difference between an equivalence intake surface adhesion fuel amount being given as a function of a parameter for operating the internal combustion engine and a predetermined period previous intake surface adhesion fuel amount of being given as a function a parameter for operating the internal combustion engine by a constant of a parameter for operating the internal combustion engine, a present intake surface adhesion fuel amount is given as a second value adding said first value to said predetermined period previous intake surface adhesion fuel amount, and an executed result is given as a third value obtained dividing a difference between said present intake surface adhesion fuel amount and said predetermined period previous intake surface adhesion fuel amount by said predetermined period.

4. A throttle valve opening degree controlling apparatus for an internal combustion engine according to claim 1, wherein said control target value is given as said amount of the intake air flow, and a control of said first actuator for controlling the opening degree of said throttle valve is constituted to have a feed-back control so as to work for converging at said control target value in accordance with a detected value of an actual amount of the intake air flow.

5. A throttle valve opening degree controlling apparatus for an internal combustion engine according to claim 1, wherein said control target value is given as said air-fuel ratio, and a control of said first actuator for controlling the opening degree of said throttle valve is constituted to have a feed-back control so as to work for converging at said control target value in accordance with a detected value of an actual air-fuel ratio.

6. A throttle valve opening degree controlling apparatus for an internal combustion engine according to claim 1, wherein said control target value is given as an intake pipe pressure, and a control of said first actuator for controlling the opening degree of said throttle valve is constituted to have a feed-back control so as to work for converging at said control target value in accordance with a detected value of an actual intake pipe pressure.

7. A throttle valve opening degree controlling apparatus for an internal combustion engine according to claim 3, wherein each difference between an amount of fuel being supplied from said second actuator for controlling the amount of fuel being supplied and an amount of fuel being taken into said cylinders of the internal combustion engine is integrated, and an obtained integrated value is stored successively in a memory member being dividing according to a parameter for operating the internal combustion engine as a learning value for said equivalence intake surface adhesion fuel amount.

8. A throttle valve opening degree controlling apparatus for an internal combustion engine according to claim 7, wherein said amount of fuel being taken into said cylinders of the internal combustion engine is executed at least one of a detected value of an actual air-fuel ratio, an amount of the intake air flow being calculated in accordance with said intake pipe pressure and an engine speed, an amount of the intake air flow being calculated in accordance with an opening degree of said throttle valve and the engine speed, and a detected value of an actual amount of the intake air flow.

9. A throttle valve opening degree controlling apparatus for an internal combustion engine comprising a throttle valve being arranged in an intake pipe of the internal combustion engine, a throttle valve sensor for detecting an opening degree of said throttle valve being mounted on said throttle valve, a throttle valve actuator for giving the throttle valve opening degree to said throttle valve, an injector for controlling an amount of fuel being supplied into cylinders of the internal combustion engine, an engine speed detection sensor for detecting an engine speed of the internal combustion engine and being arranged in the internal combustion engine, a water temperature detection sensor for detecting an engine temperature of the internal combustion engine and being arranged in the internal combustion engine, an acceleration pedal for accelerating or decelerating the internal combustion engine, an acceleration pedal sensor for detecting an amount of an acceleration or deceleration of the internal combustion engine and being mounted to said acceleration pedal, an oxygen concentration detection sensor for detecting an amount of an oxygen concentration and being arranged to an exhaust pipe of the internal combustion engine, an air flow sensor for detecting an amount of an air flow in the internal combustion engine and being arranged to said intake pipe of the internal combustion engine, a control unit being inputted the amount of the throttle valve opening degree detected from said throttle valve sensor, the engine speed detected from said engine speed detection sensor, an engine temperature detected from said water temperature detection sensor, an amount of acceleration or deceleration detected from said acceleration pedal sensor, an air-fuel ratio detected from said oxygen concentration detection sensor, and an amount of an intake air flow detected from said air flow sensor, said control unit for executing a control processing for the throttle valve opening degree of said throttle valve, in which an amount of fuel being supplied into the internal combustion engine from said injector is controlled electronically by an amount of an intake air for flowing into the internal combustion engine and an amount of fuel being supplied into the internal combustion engine in accordance with a data being stored in said control unit for controlling the internal combustion engine wherein said control unit in said throttle valve opening degree controlling apparatus comprises further a fuel supply amount controller and a throttle valve opening degree controller, said fuel supply amount controller estimates and calculates the amount of fuel being supplied in said cylinders of the internal combustion engine with a real time, and said throttle valve opening degree controller calculates a necessary throttle valve opening degree for said throttle valve so as to give a predetermined air-fuel ratio by said oxygen concentration detection sensor in accordance with an estimating and calculating value by said fuel supply amount controller, thereby the opening degree of said throttle valve is controlled by said throttle valve actuator in accordance with a calculation value obtained from said throttle valve opening degree controller as a control target value.

10. A throttle valve opening degree controlling apparatus for an internal combustion engine according to claim 9, wherein an estimating and calculating processing in said fuel supply amount controller is constituted to have a processing in which an amount of fuel being supplied from said injector is corrected in accordance with an increase rate or a decrease rate of an amount of fuel being adhered to an inner wall surface portion of an intake air flow passage of the internal combustion engine.

11. A throttle valve opening degree controlling apparatus for an internal combustion engine according to claim 10, wherein said increase rate or said decrease rate of said intake surface adhesion fuel amount is requested from a first value multiplying a difference between an equivalence intake surface adhesion fuel amount being given as a function of a parameter for operating the internal combustion engine and a predetermined period previous intake surface adhesion fuel amount of being given as a function a parameter for operating the internal combustion engine by a constant of a parameter for operating the internal combustion engine, a present intake surface adhesion fuel amount is given as a second value adding said first value to said predetermined period previous intake surface adhesion fuel amount, and an executed result is given as a third value obtained dividing a difference between said present intake surface adhesion fuel amount and said predetermined period previous intake surface adhesion fuel amount by said predetermined period.

12. A throttle valve opening degree controlling apparatus for an internal combustion engine according to claim 9, wherein said control target value is given as said amount of the intake air flow, and a control of said throttle valve actuator is constituted to have a feed-back control so as to work for converging at said control target value in accordance with a detected value of an actual amount of the intake air flow.

13. A throttle valve opening degree controlling apparatus for an internal combustion engine according to claim 9, wherein said control target value is given as said air-fuel ratio, and a control of said said throttle valve actuator is constituted to have a feed-back control so as to work for converging at said control target value in accordance with a detected value of an actual air-fuel ratio.

14. A throttle valve opening degree controlling apparatus for an internal combustion engine according to claim 9, wherein said control target value is given as an intake pipe pressure, and a control of said throttle valve actuator is constituted to have a feed-back control so as to work for converging at said control target value in accordance with a detected value of an actual intake pipe pressure.

15. A throttle valve opening degree controlling apparatus for an internal combustion engine according to claim 12, wherein each difference between an amount of fuel being supplied from said injector and an amount of fuel being taken into said cylinders of the internal combustion engine is integrated, and an obtained integrated value is stored successively in a memory map being dividing according to a parameter for operating the internal combustion engine as a learning value for said equivalence intake surface adhesion fuel amount.

16. A throttle valve opening degree controlling apparatus for an internal combustion engine according to claim 15, wherein said amount of fuel being taken into said cylinders of the internal combustion engine is executed at least one of a detected value of an actual air-fuel ratio, an amount of the intake air flow being calculated in accordance with said intake pipe pressure and an engine speed, an amount of the intake air flow being calculated in accordance with an opening degree of said throttle valve and the engine speed, and a detected value of an actual amount of the intake air flow.

* * * * *